US012063986B2

(12) United States Patent
Casillas et al.

(10) Patent No.: US 12,063,986 B2
(45) Date of Patent: Aug. 20, 2024

(54) BRAIDED BRA WITH INTEGRATED LACINGS

(71) Applicant: NIKE, Inc., Beaverton, OR (US)

(72) Inventors: Tina M. Casillas, Portland, OR (US); Adam R. Farmer, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 99 days.

(21) Appl. No.: 17/734,485

(22) Filed: May 2, 2022

(65) Prior Publication Data

US 2022/0354189 A1 Nov. 10, 2022

Related U.S. Application Data

(60) Provisional application No. 63/185,018, filed on May 6, 2021.

(51) Int. Cl.
*A41C 3/00* (2006.01)
*A41C 5/00* (2006.01)

(52) U.S. Cl.
CPC ..... *A41C 3/0021* (2013.01); *A41C 5/00* (2013.01); *A41C 3/0057* (2013.01)

(58) Field of Classification Search
CPC ..... A41C 3/0021; A41C 5/00; A41C 3/0057
USPC ..... 450/92
See application file for complete search history.

(56) References Cited

U.S. PATENT DOCUMENTS

| | | | | |
|---|---|---|---|---|
| 358,711 A | | 3/1887 | Wells | |
| 2,533,060 A | * | 12/1950 | Silvain | A41C 3/00 450/86 |
| 2,988,086 A | * | 6/1961 | Rydin | A41C 3/00 450/76 |

(Continued)

FOREIGN PATENT DOCUMENTS

| | | | |
|---|---|---|---|
| EP | 1146251 | B1 | 10/2005 |
| EP | 2682012 | A1 | 1/2014 |
| EP | 3095340 | A1 | 11/2016 |
| WO | 2020/056313 | A1 | 3/2020 |

OTHER PUBLICATIONS

CHICTRY Women's Adjustable Spaghetti Shoulder Straps Criss Cross Workout Sports Bra, Amazon, Available online at: <www.amazon.com>, ASIN: B08HLP2XZ1, Sep. 7, 2020, 5 pages.
Fishnet Sports Bra, VV Ehouse; Available online at: <www.vv-ehouse.com>, Jan. 16, 2021, 4 pages.

(Continued)

*Primary Examiner* — Timothy K Trieu

(74) *Attorney, Agent, or Firm* — Shook, Hardy & Bacon L.L.P.

(57) ABSTRACT

Aspects herein are directed to a braided textile component for a bra. The braided textile component includes base strands of a first material forming a breast-covering portion and a lacing that includes one or more strands of a second material with a property that is different from the first property. The lacing is integrally braided within a portion of the braided textile component. A first segment of the lacing may extend in a first direction away from a medial perimeter of the breast-covering portion, and a second segment may extend in a second direction towards the medial perimeter. The lacing may extend along the lateral region of the breast-covering portion, and the braided textile component may include a second lacing extending along the medial region. The braided textile may also include a second breast-covering portion with base strands and an integrated lacing.

16 Claims, 10 Drawing Sheets

(56) References Cited

U.S. PATENT DOCUMENTS

| | | | |
|---|---|---|---|
| D259,370 | S | 6/1981 | Schreiber et al. |
| 4,458,684 | A | 7/1984 | Frankel |
| D300,382 | S | 3/1989 | Keithan |
| D301,518 | S | 6/1989 | Schreiber-miller et al. |
| 5,011,452 | A | 4/1991 | Kelly |
| 6,817,030 | B2 | 11/2004 | Desai |
| 7,267,599 | B2 | 9/2007 | Allen et al. |
| 8,282,441 | B2 | 10/2012 | Mays |
| 8,657,643 | B2 | 2/2014 | Perez |
| 9,538,794 | B2 | 1/2017 | Turlan |
| 10,368,590 | B2 * | 8/2019 | Diaz ..... D04B 35/10 |
| 10,448,679 | B1 | 10/2019 | Roddis et al. |
| 2010/0022165 | A1 | 1/2010 | Silverman et al. |
| 2011/0197330 | A1 | 8/2011 | Simpson |
| 2016/0338422 | A1 | 11/2016 | Caprow-D'Avanzo |
| 2016/0353810 | A1 | 12/2016 | Barnes et al. |
| 2018/0148717 | A1 | 5/2018 | Armstrong et al. |
| 2018/0352874 | A1 | 12/2018 | Cahan et al. |
| 2019/0116891 | A1 | 4/2019 | Wisniewski |
| 2020/0337389 | A1 | 10/2020 | Busnel et al. |
| 2020/0375269 | A1 | 12/2020 | Andon et al. |

OTHER PUBLICATIONS

International Search Report and Written Opinion received for PCT Patent Application No. PCT/US2022/027662, mailed on Sep. 30, 2022, 11 pages.

* cited by examiner

BRAIDED BRA WITH INTEGRATED LACINGS

CROSS-REFERENCE TO RELATED APPLICATIONS

This application, entitled "Braided Bra with Integrated Lacings," claims the benefit of priority of U.S. Prov. App. No. 63/185,018, entitled "Braided Bra with Integrated Lacings," and filed May 6, 2021. The entirety of the aforementioned application is incorporated by reference herein.

TECHNICAL FIELD

Aspects herein relate to a bra with a braided component having integrated lacings and a method of manufacturing a braided component with integrated lacing for a bra.

BACKGROUND

Traditional bras, including sport bras, utilize different materials and constructions to provide a particular level of support to the wearer. Some bras providing higher support are desired for activities involving greater movement, such as high-intensity exercise. Other bras providing lower levels of support may be more comfortable and therefore preferred for activities involving less movement. Wearers typically have separate bras for high support and lower support and may change bras between different types of activities based on the level of support needed. Additionally, while some traditional bras have sliders to adjust the length of the shoulder straps, the use of sliders typically adjusts the fit of the bra only in one direction (e.g., the vertical direction). As such, traditional bras do not offer a mechanism to effectively vary the level of support within the bra for different activities.

BRIEF DESCRIPTION OF THE DRAWINGS

Examples of aspects herein are described in detail below with reference to the attached drawings figures, wherein.

DETAILED DESCRIPTION

Figure 1:
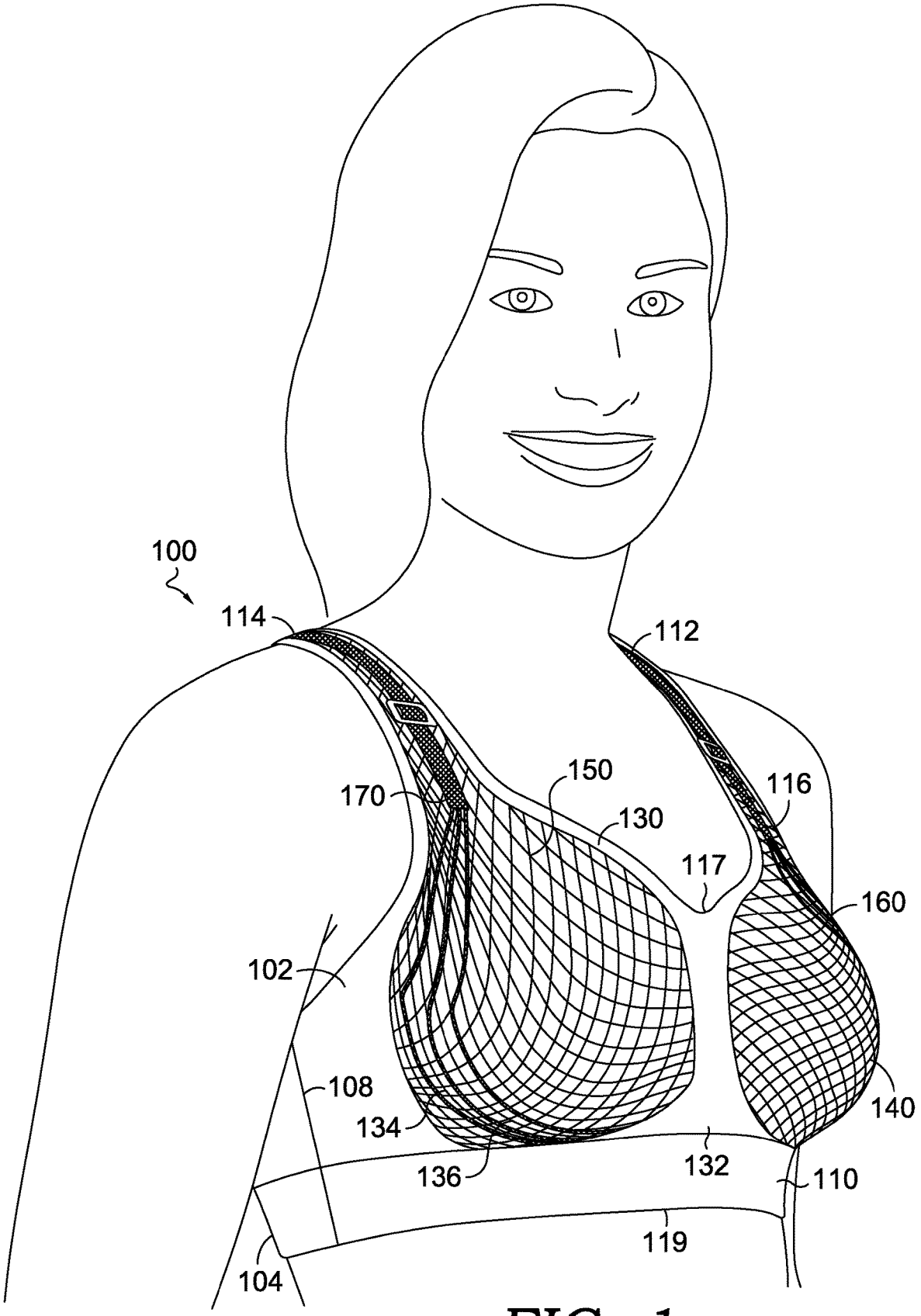
FIG. 1 illustrates a front left perspective view of an example braided bra with lateral lacings being worn in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Bras that are worn during athletic activities, such as sports bras, are typically aimed to provide a particular level of support. For example, some bras offer a high level of support for the wearer's breasts and are generally desired for activities involving a lot of movement or impact such as high-intensity exercises. Other types of bras that offer lower levels of support can be more comfortable during activities involving less impact, such as yoga or Pilates. However, traditional bras typically do not offer both levels of support, and a person may need to switch bras between different types of activities if different levels of support are desired. Certain types of workouts involve both high-intensity and lower-intensity workouts such that it may be desirable to adjust the level of support without needing different bras. Additionally, as athleisure wear and sports bras are commonly worn for non-athletic, everyday activities, someone wearing a low-support bra for comfort while running errands may wish to easily transition into a high-support bra for a workout without changing. While some existing bras for athletic activities include slides (also referred to as sliders) to adjust the length of the shoulder straps, this type of adjustment is only in one direction and does not change the support around a wearer's breasts. Additionally, the slides may often be located on the back portion of the shoulder straps, preventing a wearer from easily adjusting the straps while the bra is worn.

At a high level, aspects herein are directed to a braided textile component for a bra. The braided textile component includes base strands of a first material forming a breast-covering portion and a lacing that includes one or more strands of a second material. The lacing is integrally braided with a portion of the braided textile component such that a first segment of the lacing extends in a first direction away from a medial perimeter of the breast-covering portion and a second segment extends in a second direction towards the medial perimeter. The first material of the base strands has a first property that is different than a second property of the second material of the lacing. For example, the second material of the lacing may have a higher denier than the first material forming the base strands. Additionally or alternatively, the second material of the lacing may have a higher tenacity than the first material forming the base strands.

The lacing may include an unintegrated segment that floats over at least a portion of the base strands of the braided textile component. This unintegrated segment may be positioned in an upper region of the breast-covering portion, which may form part of a shoulder strap. The unintegrated segment of the lacing may be at least about two inches in length such that a wearer of a bra with the braided textile component may grasp the unintegrated segment with their fingers to pull on the lacing.

In example aspects, the lacing is a lateral lacing that extends from a lower perimeter of the breast-covering portion, along a lateral region of the breast-covering portion, and to an upper region of the breast-covering portion. The braided textile component may also include a medial lacing formed of one or more strands of the second material integrally braided with a second portion of the braided textile component along a medial region of the breast-covering portion. The medial lacing may include a first segment extending in a third direction towards the medial perimeter of the breast-covering portion and a second segment extending in a fourth direction away from the medial perimeter. The medial lacing may also include an unintegrated segment that is joined with the unintegrated segment of the lateral lacing. In this way, a single unintegrated segment having strands from both the medial lacing and the lateral lacing may be grasped at once.

Further aspects include a bra that includes a braided textile component forming a first breast-covering portion and a second breast-covering portion. Each of the breast-covering portions may have a similar construction as the braided textile component described above. That is, each breast-covering portion is braided together with base strands of a first material and include a lacing integrated into the braided textile component and including one or more strands of a second material. The first material has a first property that is different than a second property of the second material. In some aspects, the first and second breast-covering portions are braided separately and affixed together within a central region of the bra.

In example aspects, the lacings of the bra's braided textile component include a first lateral lacing and a second lateral lacing. The first lateral lacing extends from a lower perimeter of the first breast-covering portion, along a lateral region of the first breast-covering portion, and to an upper region of the first breast-covering portion. More specifically, the first lateral lacing may include a first integrated segment that extends in a first direction away from the central region between the first and second breast-covering portions and a second integrated segment that extends in a second direction towards the central region. Similarly, the second lateral lacing extends from a lower perimeter of the second breast-covering portion, along a lateral region of the second breast-covering portion, and to an upper region of the second breast-covering portion. Further, the second lateral lacing may include a first integrated segment that extends in a third direction away from the central region and a second integrated segment that extends in a fourth direction towards the central region. In example aspects, the first and fourth directions are generally parallel, while the second and third directions are generally parallel. Each of the first and second lateral lacings may also include an unintegrated segment in which the lateral lacing floats over part of the braided textile component in an upper region of the respective breast-covering portion. The upper region may form a shoulder portion of the bra.

Some aspects of the bra also include a first medial lacing and a second medial lacing made of one or more strands of the second material. The first medial lacing may be integrated into the braided textile component such that it extends from the lower perimeter of the first breast-covering portion, along a medial region of the first breast-covering portion, and towards the upper region of the first breast-covering portion. Similarly, the second medial lacing may be integrated into the braided textile component such that it extends from the lower perimeter of the second breast-covering portion, along a medial region of the second breast-covering portion, and towards the upper region of the second breast-covering portion.

A method of manufacturing includes braiding a first braided textile component forming a first breast-covering portion and a second braided textile component forming a second breast-covering portion. The method also includes integrally braiding a first lacing within the first braided textile component and a second lacing within the second braided textile component. As previously described, the textile components may be formed with base strands of a first material having a first property, and the lacings may include strands of a second material having a second property that is different than the first property. In some aspects, the first braided textile component and the second braided textile component are braided separately and affixed together at least along their respective medial perimeters. Further aspects of the method include floating an unintegrated segment of the first lacing over at least part of the first braided textile component in the upper region of the first breast-covering portion and floating an unintegrated segment of the second lacing over at least part of the second braided textile component in an upper region of the second breast-covering portion.

In example aspects, the first and second lacings are each a lateral lacing extending from a lower perimeter, along a lateral region, and to an upper region of the respective breast-covering portion. Some aspects of the method of manufacturing the bra also include integrally braiding a first medial lacing with the first braided textile component and a second medial lacing with the second braided textile component. Each medial lacing may extend from the lower perimeter, along a medial region, and to the upper region of the respective breast-covering portion.

As used herein, the term "bra" encompasses any structure configured to be worn around a wearer's torso and at least partially cover the wearer's breasts. Although aspects herein are discussed with respect to a bra, it is understood that the disclosed technology is not limited to a bra and may be applied to any upper-torso garment used to support breast tissue, such as camisoles, swimwear, tank tops, or other garments with built-in breast support. The term "breast-covering portion" means the portion of the bra that substantially covers a wearer's breast. Thus, as used herein the first breast-covering portion is configured to substantially cover a wearer's left breast, and the second breast-covering portion is configured to substantially cover a wearer's right breast.

Positional terms used when describing the bra, such as front, sides, back, superior, inferior, top, bottom, upper, lower, lateral, medial, right, left, inner-facing, and outer-facing and the like, are used with respect to the bra being worn as intended with the wearer standing upright such that the lower portion of the bra extends around the wearer's torso and the upper portion of the bra is positioned generally over the wear's chest. Additionally, the front portion of the bra is configured to at least partially cover the wearer's breasts while the back portion is configured to at least partially cover the wearer's back. Shoulder straps are configured to extend over the wearer's shoulders from the front portion to the back portion and at least partly define openings through which the wearer's arms extend and an opening through which the wearer's head and neck extend. It should be understood, however, that use of positional terms do not depend on the actual presence of a human being for interpretative purposes.

The term "braided textile component," as used herein, refers to a textile created by braiding. Braiding is a process of interlacing or interweaving three or more strands of yarns and/or filaments diagonally to a product axis. The product axis is the axis along which the product is generally braided. For example, a product axis for a braided bra may extend generally from a neck opening to a torso opening. Interlacing diagonally means that the strands make an angle (referred to as a braiding angle) with the product axis, which can be between 1° and 89° but is usually in the range of 30° and 80°. Some aspects of the braided textile component also include one or more longitudinal strands that extend parallel with the product axis, such as is performed with triaxial braiding. The braided textile component may be formed from linear braided products (ropes), hollow tubular braided shells, or solid braided structures (one, two, or three-dimensional textiles) with constant or variable cross-sections, and of closed or open appearance.

As described further herein, braiding offers advantages over other processes, such as knitting or weaving. For example, braiding reduces frictional forces applied to the yarns used in the creation of the braided textile component. Braiding also has the ability to use high denier yarns (e.g., yarns from about 800 D to about 20000 D, from about 1000 D to about 10000 D, from about 1000 D to about 5000 D, and the like) as well as the ability to combine different types of yarns with non-yarn materials, such as, for example, rubber strands, ropes, metals, and the like. Additionally, the resulting braided structure (e.g., a braided textile component) may have a greater ability to conform to various shapes compared to conventional woven materials while also having a greater ability to lock in a particular shape and efficiently distribute forces compared to conventional knit materials.

The term "integrally braided," as used herein, may mean a braided textile having at least one common strand interlaced or interwoven to form the braided structure in multiple areas of the textile. In this way, areas that are integrally braided together have a seamless transition.

Additionally, there are various numerical measurements provided herein. Unless indicated otherwise, the term "about" or "substantially" with respect to a measurement means within ±10% of the indicated value. Further, unless indicated otherwise, all measurements provided herein are with respect to the bra being in a resting state (i.e., a non-stretched) at standard ambient temperature and pressure (298.15 K and 100 kPa).

Figure 2A:
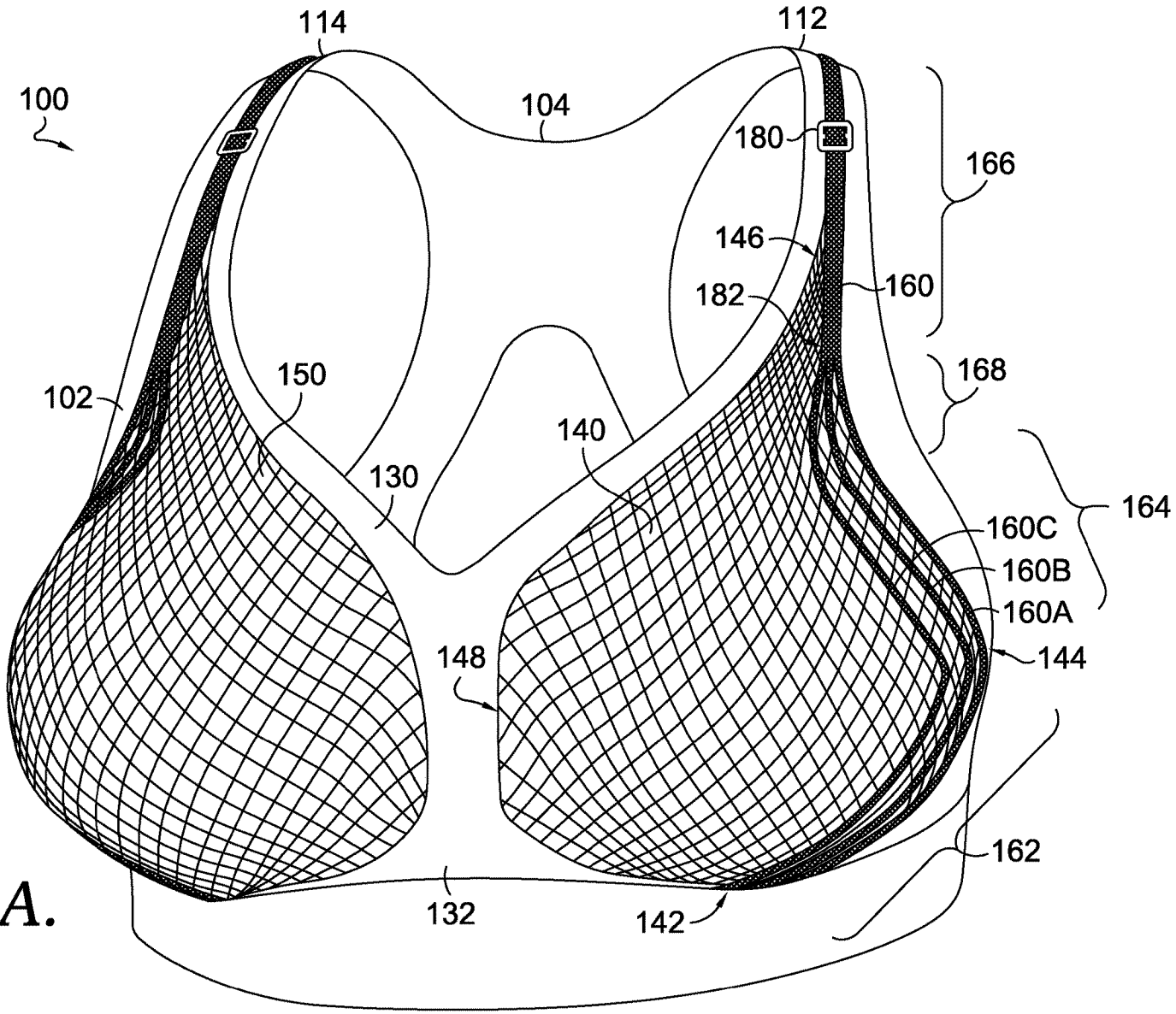
FIGS. 2A and 2B illustrate front perspective views of the bra of FIG. 1 in accordance with aspects herein.
Figure 2B:
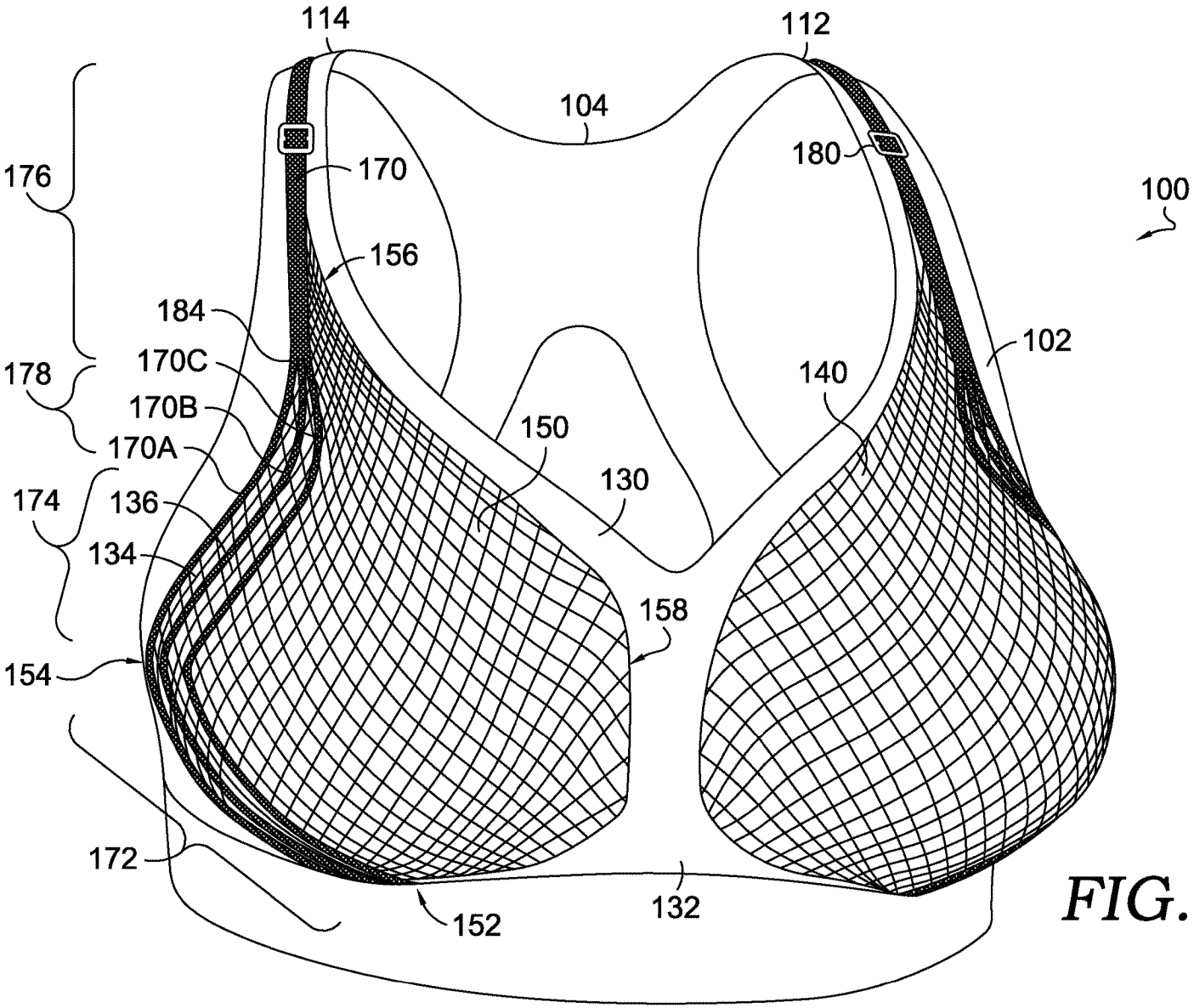
Figure 3:
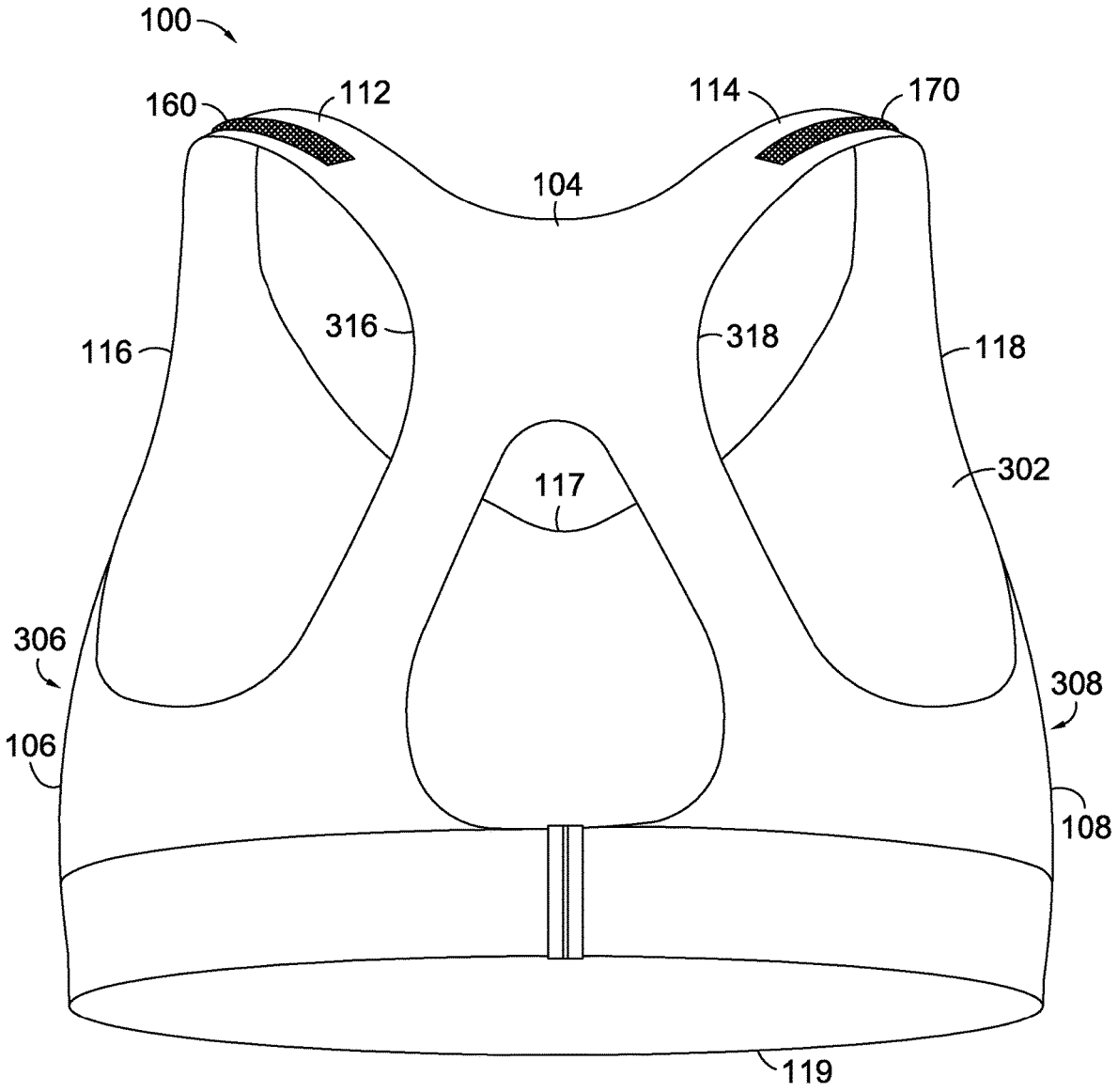
FIG. 3 illustrates a back view of the bra of FIG. 1 in accordance with aspects herein.

FIGS. 1, 2A, 2B, and 3 depict various views of example bra 100. FIG. 1 depicts the example bra 100 being worn. FIGS. 2A and 2B depict a front right perspective view and a front left perspective view, respectively, and FIG. 3 depicts a back view of the bra 100. As illustrated, the bra 100 includes a front portion 102 that typically covers at least a portion of the wearer's chest when the bra 100 is in an as-worn configuration and a back portion 104 that typically covers at least a portion of the wearer's back when the bra 100 is in the as-worn configuration. The bra 100 may also include a pair of shoulder straps 112 and 114, each extending between the front portion 102 and the back portion 104. The front portion 102 generally extends from a first armhole edge 116 to a second armhole edge 118 (as seen in FIG. 3), from a first front lateral edge 106 to a second front lateral edge 108 (as seen in FIG. 3), and from a neckline edge 117 to a bottom edge 119. The shoulder straps 112 and 114 extend from the upper part of the front portion 102, and an optional underband 110 forms a lower area of the front portion 102.

The back portion 104 extends from shoulder straps 112 and 114 joining the back portion 104 to the front portion 102. The back portion 104 generally extends from a first armhole edge 316 to a second armhole edge 318, from a first back lateral edge 306 to a second back lateral edge 308. In example aspects, the first back lateral edge 306 and the second back lateral edge 308 may each comprise a seamed edge where the back portion 104 is joined to the front portion 102 along the first front lateral edge 106 and the second front lateral edge 108. Alternatively, the first back lateral edge 306 and the second back lateral edge 308 may comprise a hypothetical boundary demarcating the limits of the back portion 104, while the first front lateral edge 106 and the second front lateral edge 108 may comprise a hypothetical boundary demarcating the limits of the front portion 102. In some aspects, the back portion 104 may include one or more closure mechanisms, such as one or more hook and eye structures, that releasably couple two sections of the back portion 104. The configuration in FIG. 3 is illustrative only and the back portion may have other configurations known within the field.

At least a portion of the front portion 102 of the bra 100 is formed of a braided textile component 130 that includes a first breast-covering portion 140 and a second breast-covering portion 150. The braided textile component 130 is made of base strands such that each of the first breast-covering portion 140 and the second breast-covering portion 150 are made of base strands (e.g., base strands 134 and 136). The base strands are braided together such that each base strand extends diagonally from a product axis. The braid structure of the first and second breast-covering portions 140 and 150 may have a greater ability to conform to various shapes, such as a wearer's breasts, while also having sufficient strength to lock in place and efficiently distribute forces, providing advantages over some knit and woven materials.

For simplicity, FIGS. 1, 2A-2B as well as other figures herein schematically depict the braided structure as lines, and it should be understood that each line depicted within the braided textile component 130 represents a braided strand as defined above. Also for simplicity, the braided structure is depicted in these figures in only part of the front portion 102, but it is contemplated that the braided structure of the braided textile component 130 may form all or substantially all of an outer-facing surface of the front portion 102. Further, the braided textile component 130 may have different braid densities. For example, central regions of the first and second breast-covering portions 140 and 150 may have a lower braid densities such that the spacing between the strands is greater than areas with higher braid densities. Higher braid densities may be in areas of the front portion 102 shaded white in FIGS. 1 and 2, such as the shoulder straps 112 and 114, a perimeter of the first and second breast-covering portions 140 and 150, a central region 132, and the underband 110.

As portions of the braided structure may be more open, some aspects of the front portion 102 of the bra 100 also optionally include a lining layer 302 forming an inner-facing surface of the front portion 102 as visible in FIG. 3. The lining layer 302 may be a knitted or woven textile and may provide modesty to the wearer. The lining layer 302 may extend from the first armhole edge 116 to the second armhole edge 118, from the first front lateral edge 106 to the second front lateral edge 108, and from the neckline edge 117 to the bottom edge 119. In some aspects, the lining layer 302 is attached to the braided textile component 130 along their respective edges. In some aspects, the lining layer 302 is positioned underneath at least part of the first breast-covering portion 140 and at least part of the second breast-covering portion 150 of the braided textile component 130, but the lining layer 302 may have a smaller surface area than the braided textile component 130 such that there may be one or more portions of the braided textile component 130 that are not adjacent the lining layer 302. In some aspects, the lining layer 302 may only be present at areas of the braided textile component 130 having lower braid densities such as, for example, in the first and second breast-covering portions 140 and 150.

The central region 132 of the braided textile component 130 separates the first breast-covering portion 140 and the second breast-covering portion 150. The first breast-covering portion 140 may extend from the central region 132 to the first front lateral edge 106, and the second breast-covering portion 150 may extend from the central region 132 to the second front lateral edge 108. The central region 132 may define a medial perimeter 148 of the first breast-covering portion 140 and a medial perimeter 158 of the second breast-covering portion 150. In example aspects, the first breast-covering portion 140 and the second breast-covering portion 150 are braided separately and affixed together in the central region 132. For example, the first breast-covering portion 140 and the second breast-covering portion 150 may be permanently affixed together via stitching or bonding in the central region 132. In this way, the central region 132 may comprise a seam. In some aspects, the first and second breast-covering portions 140 and 150 may be releasably coupled in the central region 132 via one or more buttons, pairs of hooks and eye, hooks and loops, and the like. In alternative aspects, the first and second breast-covering portions 140 and 150 may be integrally braided such that central region 132 may be seamless.

The braided textile component 130 further includes lacings integrated into the braided structure. For example, the first breast-covering portion 140 includes a first lateral lacing 160 and the second breast-covering portion 150 includes a second lateral lacing 170. The lacings are made of a different material than the base strands. For example, the base strands are made of a first material with a first property while the first lateral lacing 160 and the second lateral lacing 170 are both made of a second material with a different property. In some aspects, the second material of the first and second lateral lacings 160 and 170 has a higher denier than the first material of the base strands. For example, the second material may comprise strands of a denier within a range from about 800 D to about 20000 D, from about 1000 D to about 10000 D, and from about 1000 D to about 5000 D, while the first material may comprise strands of a denier less than about 800 D. Additionally or alternatively, the second material may have a higher tenacity than the first material of the base strands. For example, the second material may include carbon fiber yarns, aramid fiber yarns, liquid crystal polymer yarns, high strength nylon yarns, and the like. In example aspects, the first material of the base strands is a nylon having a lower denier and/or tenacity than the second material. In other aspects, the first material is a polyester having a lower denier and/or tenacity than the second material. In some aspects, the first material of the base strands includes nylon and elastane or polyester and elastane. In some examples, the first material and the second material may differ in other properties, such as elasticity or color.

In example aspects, the first and second lateral lacings 160 and 170 within the braided textile component 130 are intended to adjust support to lateral aspects of a wearer's breast when the bra 100 is worn. As such, the first lateral lacing 160 may extend along a lateral region 144 of the first breast-covering portion 140, and the second lateral lacing 170 may extend along a lateral region 154 of the second breast-covering portion 150. Further, the first lateral lacing 160 may extend from a lower region 142 to an upper region 146 of the first breast-covering portion 140, and the second lateral lacing 170 may extend from a lower region 152 to an upper region 156 of the second breast-covering portion 150. In this way, each of the first and second lateral lacings 160 and 170 may extend the entity of or a substantial part of the length of the respective breast-covering portion. In some aspects, the lower regions 142 and 152 are lower perimeters of the first and second breast-covering portions 140 and 150, respectively, which may be adjacent the underband 110. Further, some aspects of the upper regions 146 and 156 are configured to cover the top of a wearer's breasts when the bra 100 is worn. In some aspects, the upper regions 146 and 156 include the regions configured to cover a wearer from the top of the breasts to the shoulders when the bra 100 is worn. In this way, the upper region 146 of the first breast-covering portion 140 may form a first shoulder portion corresponding to at least part of the shoulder strap 112, and the upper region 156 of the second breast-covering portion 150 may form a second shoulder portion corresponding to at least part of the shoulder strap 114.

In example aspects, the first lateral lacing 160 and the second lateral lacing 170 each contour around a wearer's breast when the bra 100 is worn by extending in different directions. For example, the first lateral lacing 160 includes a first segment 162 that extends upward from the lower region 142 and a second segment 164 that extends from the first segment 162 towards the upper region 146. The first segment 162 extends upward from the lower region 142 in a first direction away from the central region 132, and the second segment 164 extends from the first segment 162 in a second direction towards the central region 132. The angle between the first direction and the second direction may be with a range from about 45 degrees to about 135 degrees, from about 75 degrees to about 115 degrees, and from about 90 degrees to about 110 degrees.

The second lateral lacing 170 may have a construction that mirrors the first lateral lacing 160. For example, the second lateral lacing 170 may include a first segment 172 that extends upward from the lower region 152 of the second breast-covering portion 150 and a second segment 174 that extends from the first segment 172 towards the upper region 156. The first segment 172 extends upward from the lower region 152 in a third direction away from the central region 132, and the second segment 174 extends from the first segment 172 in a fourth direction towards the central region 132. The angle between the third direction and the fourth direction may be with a range from about 45 degrees to about 135 degrees, from about 75 degrees to about 115 degrees, and from about 90 degrees to about 110 degrees.

The first, second, third, and fourth directions may all be diagonal to a product axis of the braided textile component 130. In some aspects, the first direction of the first segment 162 of the first lateral lacing 160 is parallel to the fourth direction of the second segment 174 of the second lateral lacing 170, and the second direction of the second segment 164 of the first lateral lacing 160 is parallel to the third direction of the first segment 172 of the second lateral lacing 170.

At least part of each of the first and second lateral lacings 160 and 170 may be integrated into the respective breast-covering portion via braiding. For example, the first segment 162 and the second segment 164 of the first lateral lacing 160 may be integrally braided with base strands of the first breast-covering portion 140, and the first segment 172 and the second segment 174 of the second lateral lacing 170 may be integrally braided with base strands of the second breast-covering portion 150. As such, the first segments 162 and 172 and the second segments 164 and 174 are also referred to herein as integrated segments. The first and second lateral lacings 160 and 170 may be intertwined with the base strands in a similar manner as the base strands are intertwined together. In this way, the first segment 162 and the second segment 164 may each run parallel to base strands forming the first breast-covering portion 140, and the first segment 172 and the second segment 174 may each run parallel to base strands forming the second breast-covering portion 150. In this way, tension applied to the lateral lacings 160 and 170 may be effectively distributed to other portions of the respective first and second breast-covering portions 140 and 150 via the braided structure.

In example aspects, the first lateral lacing 160 and the second lateral lacing 170 each comprise multiple strands. The first lateral lacing 160, for instance, includes three strands 160A, 160B, and 160C, and the second lateral lacing 170 includes three strands 170A, 170B, and 170C. It is contemplated that the first and second lateral lacings 160 and 170 may have more or less strands. The strands 160A, 160B, and 160C may be generally parallel to each other in the first and second segments 162 and 164, and the strands 170A, 170B, and 170C may be generally parallel to each other in the first and second segments 172 and 174. Further, in some aspects, the strands in each of the first and second lateral lacings 160 and 170 may be spaced apart from each other by base strands extending parallel to the lateral lacing. In one example, one base strand (e.g., the base strand 134 in FIG. 2B) is positioned between and running parallel to strands 170A and 170B, and one base strand (e.g., the base strands 136 in FIG. 2B) is positioned between and running parallel to strands 170B and 170C. Base strands may similarly space apart the strands 160A-C of the first lateral lacing 160. By spacing apart the strands of the lateral lacings 160 and 170, tension forces may be distributed through a wider area of the respective first and second breast-covering portions 140 and 150.

In addition to the integrated segments, the first lateral lacing 160 and the second lateral lacing 170 may each include an unintegrated segment within the upper region of the respective breast-covering portion. The first lateral lacing 160 includes an unintegrated segment 166 in the upper region 146 of the first breast-covering portion 140, and the second lateral lacing 170 includes an unintegrated segment 176 in the upper region 156 of the second breast-covering portion 150. The unintegrated segments 166 and 176 float over or overlay a portion of the braided textile component 130 within the upper regions 146 and 156, respectively. The unintegrated segments 166 and 176 may be utilized as a pull for a wearer to adjust the fit of the first and second breast-covering portions 140 and 150. Therefore, the unintegrated segments 166 and 176 have a sufficient length to permit a wearer's fingers to grasp each unintegrated segment 166 and 176. In example aspects, each unintegrated segment 166 and 176 has a length of at least five centimeters. For example, the length of each unintegrated segment 166 and 176 may be within a range from about 30 centimeters inches to about 5 centimeters, from about 25 centimeters inches to about 8 centimeters inches, or from about 20 centimeters to about 10 centimeters.

In example aspects, each unintegrated segment 166 and 176 generally extends vertically within shoulder straps 112 and 114, respectively, of the bra 100. Additionally, at least one end of each unintegrated segment 166 and 176 is adjacent to an integrated portion of the respective first and second lateral lacings 160 and 170 as explained further with respect to FIGS. 4-6. An opposite end of the unintegrated segments may be secured to the bra 100. For example, while a first end of the unintegrated segment 166 is adjacent an integrated segment, a second opposing end of the unintegrated segment 166 may be secured to the braided textile component 130 of the first breast-covering portion 140 via at least one of braiding, stitching, a ring structure, and the like. The unintegrated segment 176 may similarly be secured to the braided textile component 130 of the second breast-covering portion 150.

As described, the first and second lateral lacings 160 and 170 may be used to adjust the fit of the first breast-covering portion 140 and the second breast-covering portion 150, respectively, on the wearer. As a wearer pulls up on the unintegrated segment (e.g., unintegrated segment 166), the integrated segments of the corresponding lacing (e.g., first and second segments 162 and 164 of the first lateral lacing 160) will pull the braided structure upwards and inwards to increase the amount of support. Fastening mechanism (e.g., a slider 180) may be used to secure the unintegrated segments 166 and 176 in a shortened state after a wearer pulls up on the unintegrated segments 166 and 176. To reduce the amount of support, the unintegrated segments 166 and 176 may be lengthened through manipulation of the fastening mechanism. Because the unintegrated segments 166 and 176 are positioned on the front portion 102 of the bra 100, a wearer may easily access the unintegrated segments 166 and 176 to change the level of support without needing to remove the bra 100.

Generally, the amount of localized tension that can be exerted via the first and second lateral lacings 160 and 170 may depend on the material of the first and second lateral lacings 160 and 170 and on how the first and second lateral lacings 160 and 170 are integrated with the base strands of the first and second breast-covering portions 140 and 150, respectively. For example, lateral lacings made of a material with higher denier and/or less elasticity may create more tension on the lateral aspects of the first and second breast-covering portions 140 and 150, rather than distributing the tension, when they are pulled. Additionally, the less integrated the first and second lateral lacings 160 and 170 are with the base strands, the more the tension is localized when the first and second lateral lacings 160 and 170 are pulled. More particularly, the position at which first and second lateral lacings 160 and 170 transition from integrated to unintegrated and the manner in which the strands of the first and second lateral lacings 160 and 170 are twisted with the base strands may both affect the amount of tension.

Figure 4:
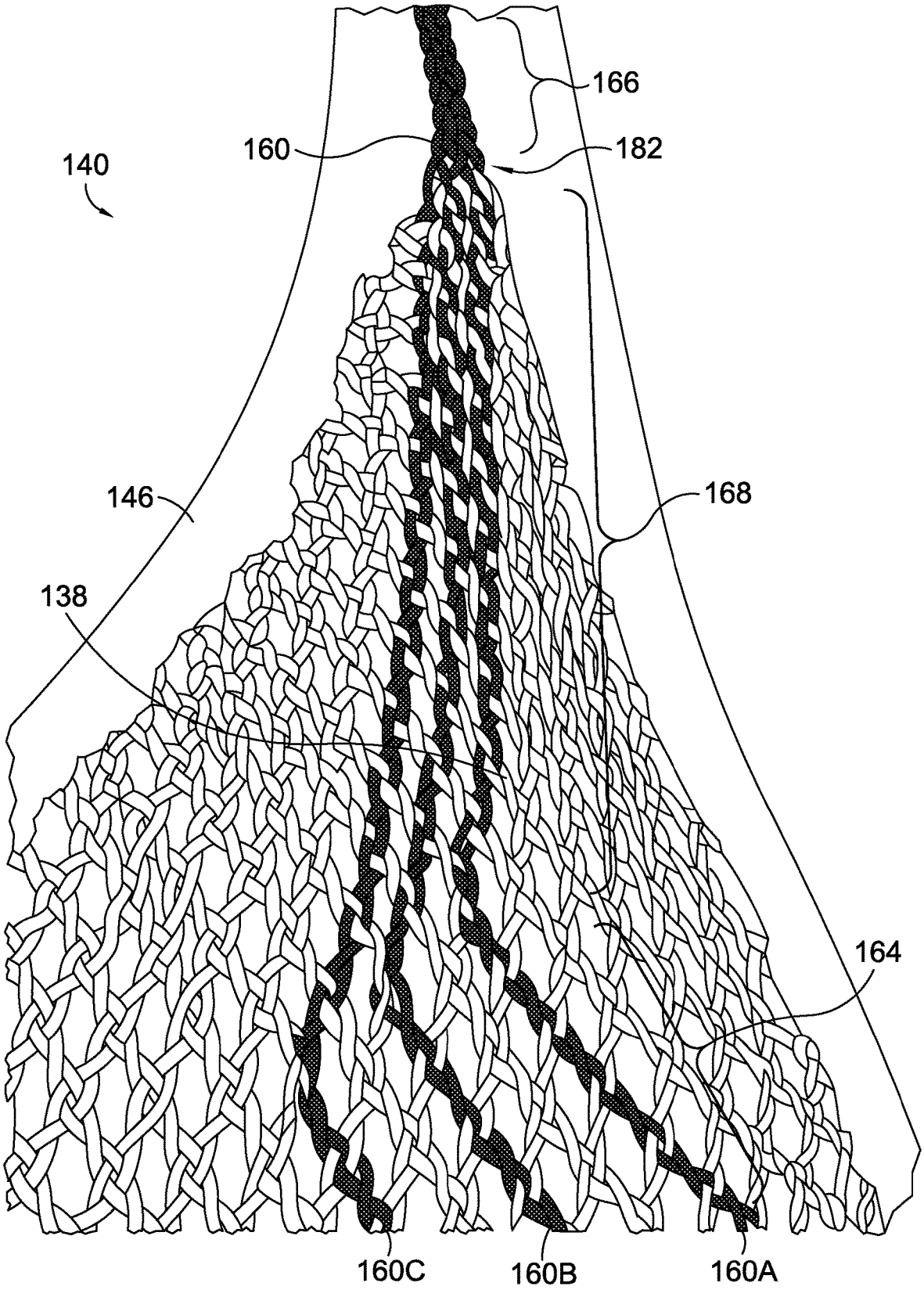
FIG. 4 illustrates a close-up view of part of a breast-covering portion of the bra of FIG. 1 in accordance with aspects herein.
Figure 5:
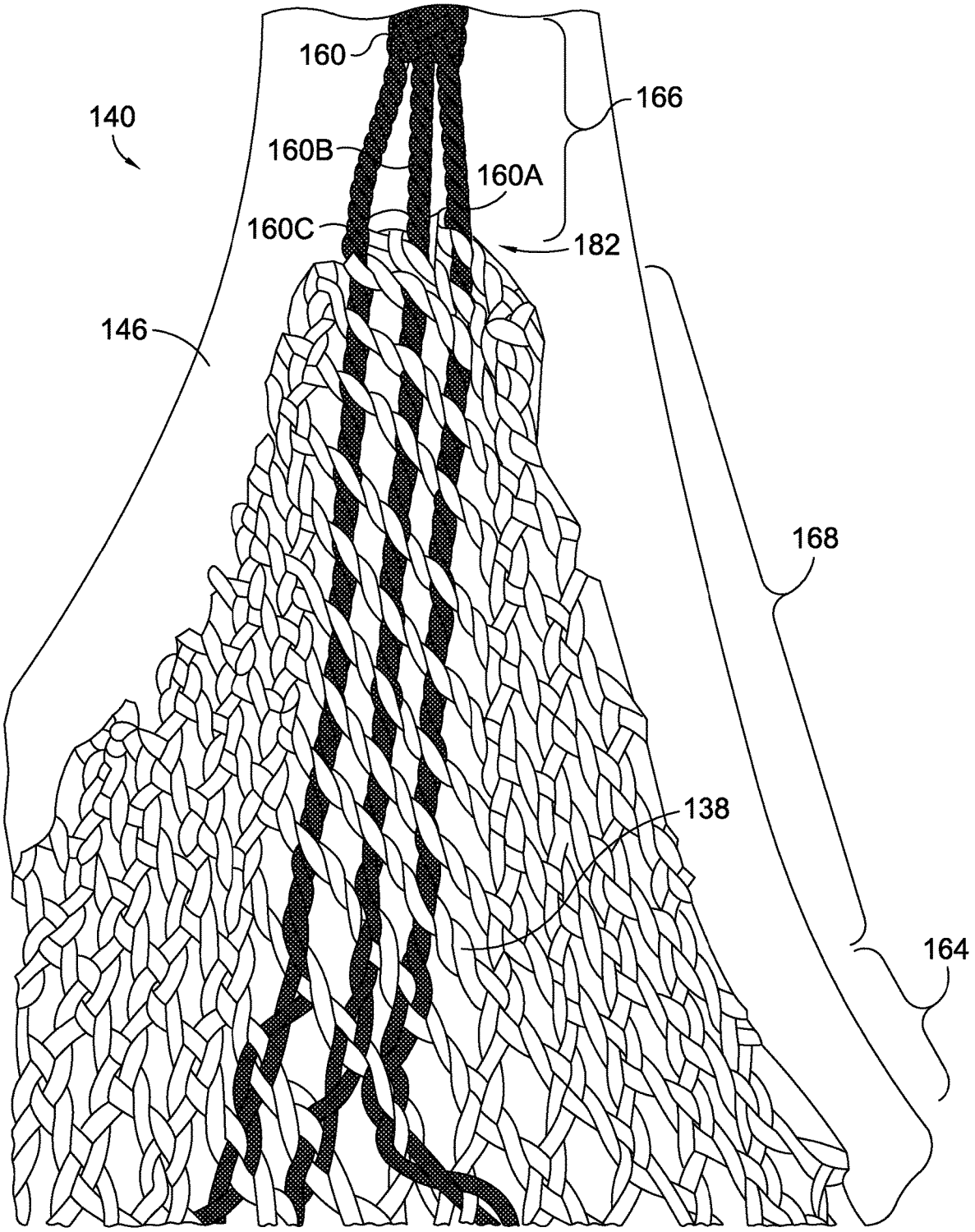
FIG. 5 illustrates a close-up view of part of a breast-covering portion of the bra of FIG. 1 with an alternative configuration in accordance with aspects herein.
Figure 6:
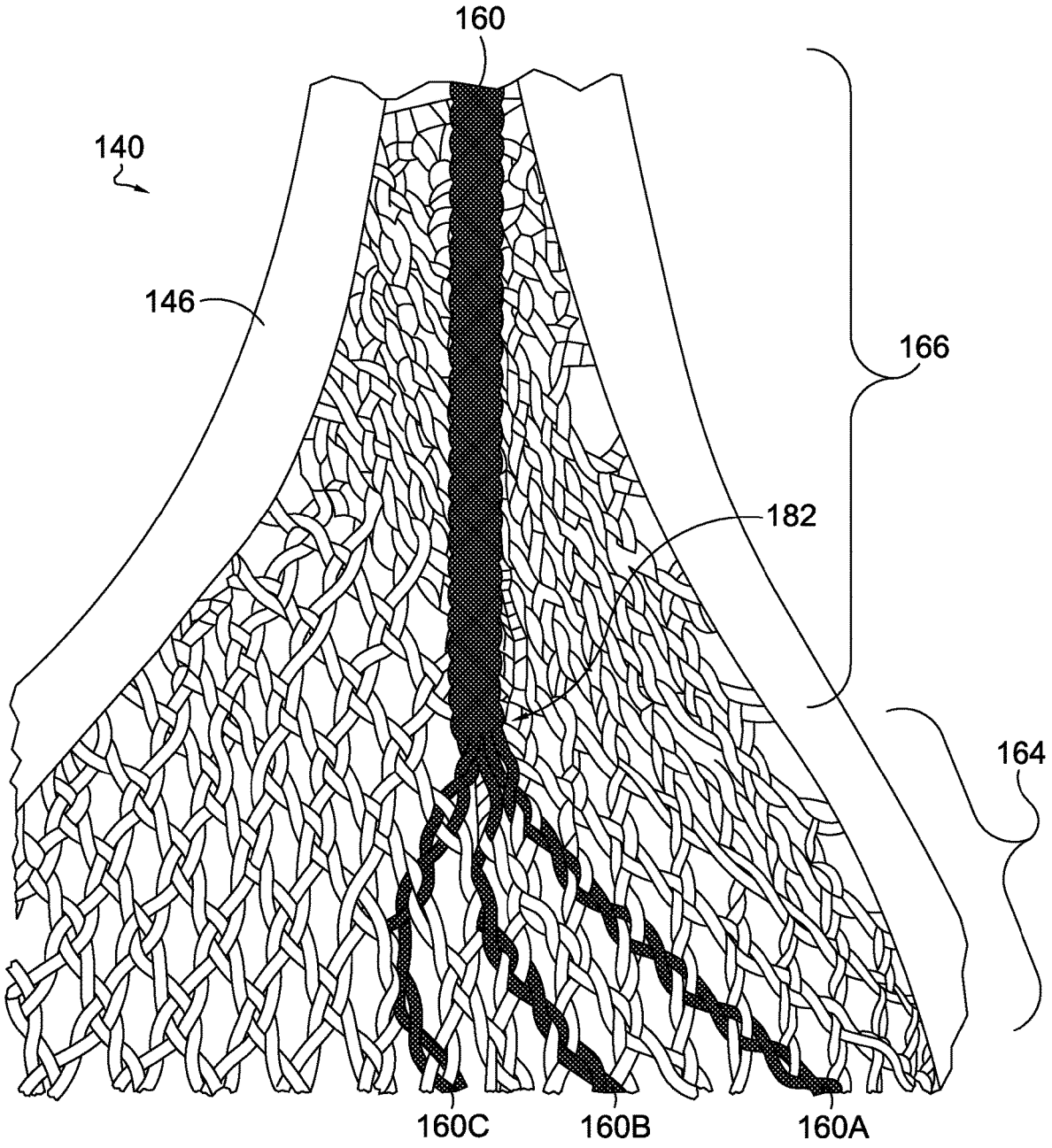
FIG. 6 illustrates a close-up view of part of a breast-covering portion of the bra of FIG. 1 with an alternative configuration in accordance with aspects herein.

FIGS. 4, 5, and 6 provide close-up views of the first breast-covering portion 140 and depict different configurations for integrating the first lateral lacing 160 within the upper region 146 of the first breast-covering portion 140. Any of the configurations in FIGS. 4-6 may be implemented in the bra 100, and the particular configuration may impact the localization of the tension forces when the unintegrated segment 166 is pulled upward. Although FIGS. 4-6 depict the first lateral lacing 160 within the first breast-covering portion 140, it should be understood that the features described herein are applicable to the second lateral lacing 170 within the second breast-covering portion 150.

As illustrated in FIGS. 4-6, the first lateral lacing 160 includes three strands 160A, 160B, and 160C that each include two yarns or filaments twisted together with base strands, such as base strand 138, which may also each include two yarns or filaments twisted together. It is contemplated that, in other aspects, each of the strands 160A-C and/or the base strands may have a different number of yarns or filaments twisted together. Within at least the second integrated segment 164 of the first lateral lacing 160, the strands 160A-C may be spaced apart from each other by a parallel base strand. The strands 160A-C may be similarly spaced apart within the first integrated segment 162 as shown in FIGS. 1, 2A, and 2B. In the unintegrated segment 166, all yarns or filaments forming the strands 160A-C may be intertwined together so that there is a single strand forming the unintegrated segment of 166.

FIG. 4 depicts the unintegrated segment 166 and a top portion of the second integrated segment 164. Additionally, the first lateral lacing 160 includes a third integrated segment 168 that extends between the second integrated segment 164 and the unintegrated segment 166. The third integrated segment 168 may extend vertically in a similar direction as the unintegrated segment 166. In this way, while the first integrated segment 162 (as seen in FIG. 2A) and the second integrated segment 164 collectively form a boundary along a lateral aspect of the wearer's breast, the third integrated segment 168 connects such boundary to the unintegrated segment 166 so that the pull of the unintegrated segment 166 can adjust the support of the first and second integrated segments 162 and 164 along the wearer's breast.

In one or more of the integrated segments, each strand 160A-C of the first lateral lacing 160 is interwoven with base strands that each strand 160A-C crosses within the braided structure of the first breast-covering portion 140. More specifically, the two yarns or filaments of each strand 160A-C are woven with the two yarns or filaments of each intersecting base strand, while the two yarns or filaments of the intersecting base strands are similarly woven with the two yarns or filaments of the strands 160A-C. For instance, as the strand 160A of the first lateral lacing 160 and the base strand 138 intersect each other, a first yarn or filament of strand 160A extends over a first yarn or filament of the base strand 138 and under a second yarn or filament of base strand 138, while the second yarn or filament of the strand 160A extends under the first yarn or filament of the base strand 138 and over the second yarn or filament of the base strand 138. With this configuration, the two yarns or filaments of each strand 160A-C are separated by the base strand, such as the base strand 138, that each strand 160A-C crosses. The first integrated segment 162 and the second integrated segment 164, for example, may be integrated in this manner. Additionally, as shown in FIG. 4, some aspects of bra 100 include the third integrated segment 168 similarly integrated so that each strand 160A-C is interwoven with the base strands within the third integrated segment 168. Integrating the third integrated segment 168 in this manner results in a less localized tension force because the force created when a wearer pulls on the adjacent unintegrated segment 166 is distributed among more base strands.

Further, due to the presence of the third integrated segment 168, the point at which the first lateral lacing 160 transitions from integrated to unintegrated, which may be referred to herein as transition point 182, is positioned within the first breast-covering portion 140 such that it is configured to be above the top of the wearer's breast when the bra 100 is worn. In example aspects, the transition point 182 is configured to be positioned at or adjacent to the wearer's clavicle when the bra 100 is worn. In other aspects, the transition point 182 may be on the wearer's shoulder when the bra 100 is worn. The transition point 182 being positioned higher or further away from the wearer's breasts may result in less localized tension when the wearer pulls on unintegrated segment 166 because more force is distributed among more base strands.

The configuration depicted in FIG. 5 also includes the first lateral lacing 160 having the third integrated segment 168 extending between the second integrated segment 164 and the unintegrated segment 166. The features described with respect to FIG. 4, including the position of the transition point 182, apply to the first lateral lacing 160 in FIG. 5 except the manner in which the third integrated segment 168 is integrated with the base strands of the braided structure. In the third integrated segment 168, the two yarns or filaments of each strand 160A-C remain twisted together, rather than becoming separated, when they cross the base strands. When each strand 160A-C intersects with a base strand (e.g., the base strand 138), the two yarns or filaments extend between the two or more yarns of the base strand. In this way, when the unintegrated segment 166 of the first lateral lacing 160 is pulled, each strand 160A-C within the third integrated segment 168 may slide between the yarns or filaments of the base strands, rather than pulling on the base strands. As a result, the configuration depicted in FIG. 5 may create more localized tension around lateral aspects of the wearer's breasts than the configuration depicted in FIG. 4 because the force of the pull is not distributed among as many base strands.

FIG. 6 depicts an alternative configuration of the first lateral lacing 160 in which the unintegrated segment 166 is positioned directly adjacent the second integrated segment 164 so that there is not a third integrated segment. As a result, the transition point 182 at which the first lateral lacing 160 changes from integrated to unintegrated is positioned lower within the upper region 146 of the first breast-covering portion 140 compared to FIGS. 4 and 5. In FIG. 6, for example, the transition point 182 may be positioned at the top of the wearer's breasts when bra 100 is worn. In other example aspects, the transition point 182 may be positioned above the top of the wearer's breast but closer to the breast than the wearer's clavicle. Due to this lower position, there are less integration points between the first lateral lacing 160 and the base strands. Therefore, the lower position of the transition point 182 may result in more localized tension around lateral aspects of the wearer's breasts when a wearer pulls on the unintegrated segment 166.

Figure 7A:
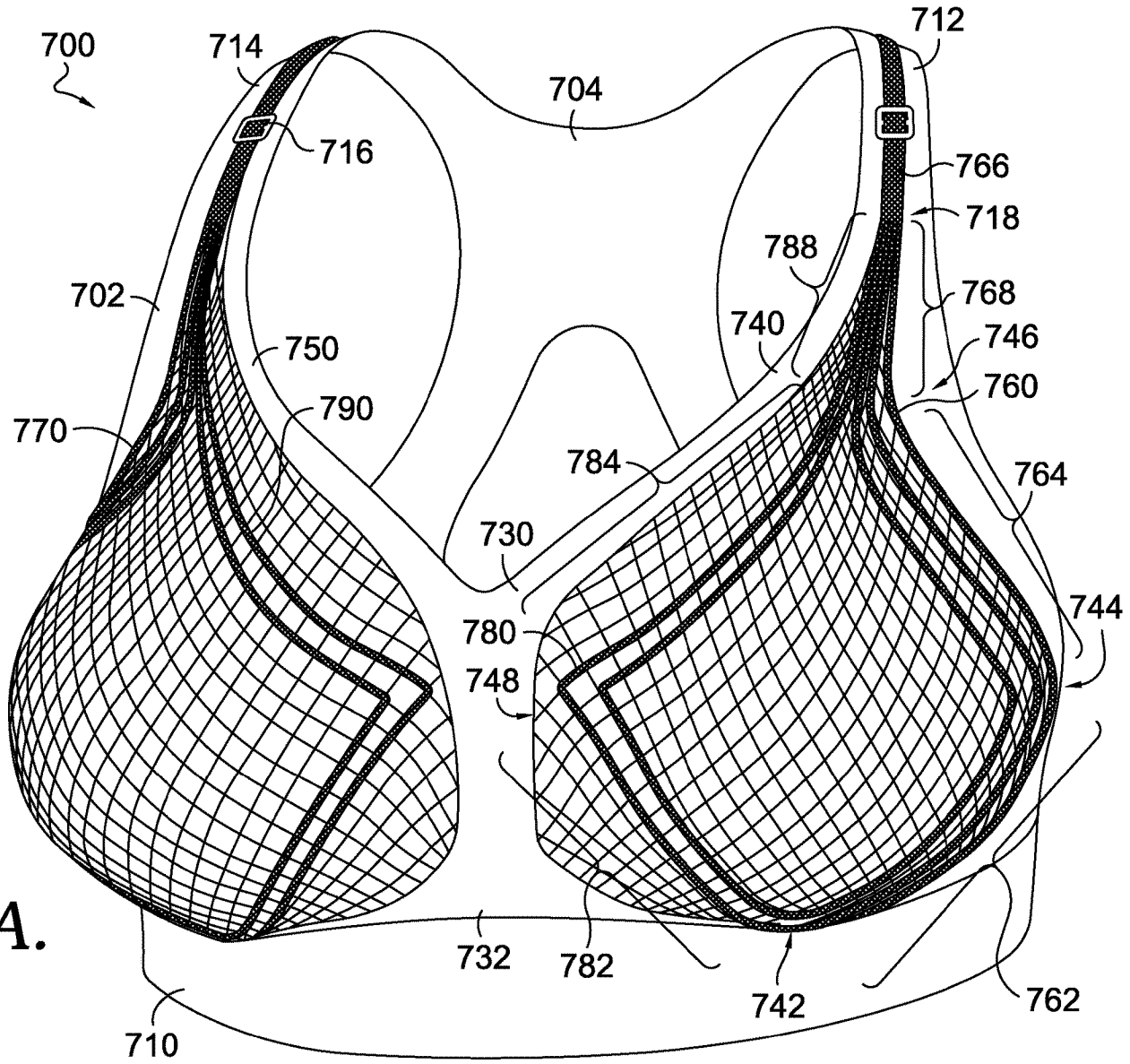
FIGS. 7A and 7B illustrate front perspective views of a braided bra with lateral and medial lacings in accordance with aspects herein.
Figure 7B:
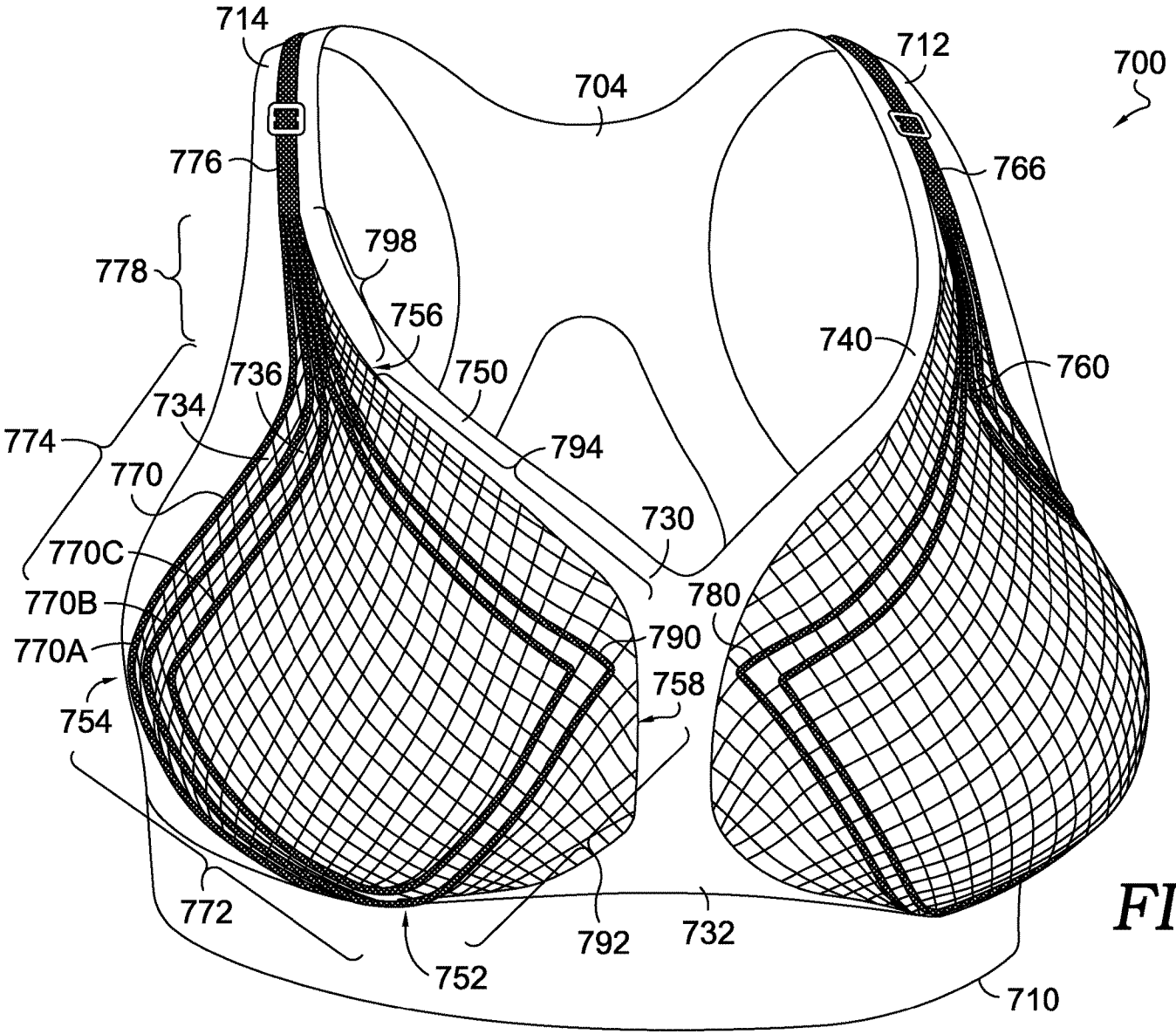

FIGS. 7A and 7B depict a front right perspective view and a front left perspective view, respectively, of an example bra 700. Bra 700 includes a front portion 702 that typically covers at least a portion of the wearer's chest when the bra 700 is in an as-worn configuration and a back portion 704 that typically covers at least a portion of the wearer's back when the bra 700 is in the as-worn configuration. The bra 700 may also include a pair of shoulder straps 712 and 714, each extending between the front portion 702 and the back portion 704. The back portion 704 may have the same characteristics as the back portion 104 of bra 100. Additionally, the front portion 702 may be substantially the same as the front portion 102 of bra 100 except with the addition of medial lacings as described herein. As such, the features of the bra 100 described above with respect to FIGS. 1-6 may apply to the bra 700 unless otherwise indicated.

At least part of the front portion 702 of the bra 700 is formed of a braided textile component 730 made of base strands. The braided textile component 730 forms a first breast-covering portion 740 and a second breast-covering portion 750. The braided textile component 730 of the bra 700 further includes a first lateral lacing 760 integrated, via braiding, into base strands of the first breast-covering portion 740 and a second lateral lacing 770 integrated, via braiding, into base strands of the second breast-covering portion 750. Additionally, the braided textile component 730 includes a first medial lacing 780 integrated, via braiding, into base strands of the first breast-covering portion 740 and a second medial lacing 790 integrated, via braiding, into base strands of the second breast-covering portion 750. The first and second lateral lacings 760 and 770 and the first and second medial lacings 780 and 790 may be made of a material having a different property, such as higher denier or tenacity, than the material of the base strands.

As described with the bra 100, the first and second lateral lacings 760 and 770 each extend from a lower region (e.g., lower regions 742 and 752), along a lateral region (e.g., lateral regions 744 and 754) to an upper region (e.g., upper regions 746 and 756) of the respective breast-covering portions. Similarly, the first medial lacing 780 extends from the lower region 742, along a medial region 748, and to the upper region 746 of the first breast-covering portion 740, and the second medial lacing 790 extends from the lower region 752, along a medial region 758, and to the upper region 756 of the second breast-covering portion 750. In some aspects, the lower regions 742 and 752 are lower perimeters of the first and second breast-covering portions 740 and 750, respectively, which may be adjacent the optional underband 710. Further, some aspects of the upper regions 746 and 756 are configured to cover the top of a wearer's breasts when the bra 700 is worn. In some aspects, the upper regions 746 and 756 include the regions configured to cover a wearer from the top of the wearer's breasts to the wearer's shoulders when the bra 700 is worn. In this way, the upper region 746 may form a first shoulder portion corresponding to at least part of the shoulder strap 712, and the upper region 756 may form a second shoulder portion corresponding to at least part of the shoulder strap 714.

The first and second lateral lacings 760 and 770 each include a first integrated segment (e.g., segments 762 and 772) and a second integrated segment (e.g., segments 764 and 774) integrally braided with base strands of the respective breast-covering portion. The first and second medial lacings 780 and 790 also each include a first integrated segment (e.g., segments 782 and 792) and a second integrated segment (e.g., segments 784 and 794) integrally braided with base strands of the respective breast-covering portion. The first lateral lacing 760 is joined with the first medial lacing 780 to form a first unintegrated lacing segment 766, and the second lateral lacing 770 is joined with the second medial lacing 790 to form a second unintegrated lacing segment 776.

The first and second unintegrated lacing segments 766 and 776 are configured to be used as a pull by the wearer to adjust the level of support within the first breast-covering portion 740 and the second breast-covering portion 750, respectively, as previously described with respect to the bra 100. As such, the first and second unintegrated lacing segments 766 and 776 may each have a length sufficient to be grasped by the wearer's fingers as described with respect to the bra 100. By pulling, the lengths of the first and second unintegrated lacing segments 766 and 776 may be shortened, and the lengths may be maintained by securing the first and second unintegrated lacing segments 766 and 776 with a fastening mechanism, such as a slider 716. Because the first and second medial lacings 780 and 790 form part of the first and second unintegrated lacing segments 766 and 776, the first and second unintegrated lacing segments 766 and 776 may be formed by more yarns or filaments than the unintegrated segments 166 and 176 of the bra 100, but other features of the unintegrated segments 166 and 176 may be applicable to the first and second unintegrated lacing segments 766 and 776.

The first and second lateral lacings 760 and 770 may each form a boundary along lateral regions of the respective breast-covering portion to support lateral aspects of the wearer's breasts, while the first and second medial lacings 780 and 790 may each form a boundary along medial regions of the respective first and second breast-covering portion 740 and 750 to support medial aspects of the wearer's breasts. To contour around the shape of the wearer's breasts, the segments of the lacings 760, 770, 780, and 790 may extend in different directions. Similar to the bra 100, the first integrated segment 762 of the first lateral lacing 760 extends upward from the lower region 742 in a first direction away from a central region 732 between the first breast-covering portion 740 and the second breast-covering portion 750, and the second segment 764 extends from the first segment 762 in a second direction towards the central region 732. The first integrated segment 782 of the first medial lacing 780 extends upward from the lower region 742 in a third direction towards the central region 732, and the second segment 784 extends from the first segment 782 in a fourth direction away from the central region 732. The first integrated segment 772 of the second lateral lacing 770 extends upward from the lower region 752 in the third direction away from the central region 732, and the second segment 774 extends from the first segment 772 in the fourth direction towards the central region 732. The first integrated segment 772 of the second medial lacing 790 extends upward from the lower region 742 in the first direction towards the central region 732, and the second segment 794 extends from the first segment 792 in the second direction away from the central region 732. The first and third directions may be substantially parallel, while the second and fourth directions may be substantially parallel. Additionally, the first, second, third, and fourth directions may be diagonal to a product axis of the braided textile component 730.

In example aspects, the lacings 760, 770, 780, and 790 each comprise multiple strands. In some aspects, each lateral lacing 760 and 770 includes three strands that extend generally parallel to each other through at least part of the respective lateral lacing, and each medial lacing 780 and 790 includes two strands that extend generally parallel to each other through at least part of the respective medial lacing. It is contemplated that more or less strands may be used for the lateral lacings and/or medial lacings. Similarly, it is contemplated that, in some aspects, the number of strands forming the lateral lacings 760 and 770 may be the same number of strands that form the medial lacings 780 and 790. For instance, there may be three strands forming each of the lacings 760, 770, 780, or 790, or there may be two strands forming each of the lacings 760, 770, 780, or 790. Further, in some aspects, the strands in at least some of the lacings 760, 770, 780, and 790 may be spaced apart from each other by base strands extending parallel to the lacing. In one example, one base strand is positioned between and running parallel to each lateral strand. For example, a base strand 734 is positioned between and parallel to strands 770A and 770B of the second lateral lacing 770, and a base strand 736 is positioned between and parallel to strands 770B and 770C. Base strands may similarly space apart strands of the first lateral lacing 760. As depicted in FIGS. 7A and 7B, strands forming the medial lacings 780 and 790 may be closer together such that they are not spaced apart by parallel base strands. In alternative aspects, strands of the medial lacings 780 and 790 are spaced apart about the same distance as strands in the lateral lacings 760 and 770.

Different configurations may be utilized within the upper aspects of the first and second breast-covering portions 740 and 750, which may impact how tension is localized by the lacings 760, 770, 780, and 790 when first and second unintegrated lacing segments 766 and 776 are pulled. Any of the configurations described with respect to FIGS. 4-6 may be utilized. In some aspects, the first lateral lacing 760 and the first medial lacing 780 may each include a third integrated segment (e.g., segments 768 and 788) extending between the second integrated segment 764 of the respective lacing and the first unintegrated lacing segment 766, and the second lateral lacing 770 and the second medial lacing 790 may each include a third integrated segment (e.g., segments 778 and 798) extending between the second integrated segment of the respective lacing and the unintegrated lacing segment 776. The third integrated segments 768, 778, 788, 798 may be integrated with the base strands as described with respect to FIG. 4 or FIG. 5. Further, the transition point (e.g., a transition point 718) between the integrated and unintegrated segments within each first and second breast-covering portion 740 and 750 may be positioned as described with respect to FIGS. 4 and 5 or FIG. 6. Generally, the more that the first and second lateral lacings 760 and 770 and the first and second medial lacings 780 and 790 are integrated with the base strands, the less localized the tension will be to the lateral aspects and medial aspects of the wearer's breasts when the first and second unintegrated lacing segments 766 and 776 are pulled because the tension may be distributed among more base strands.

Figure 8:
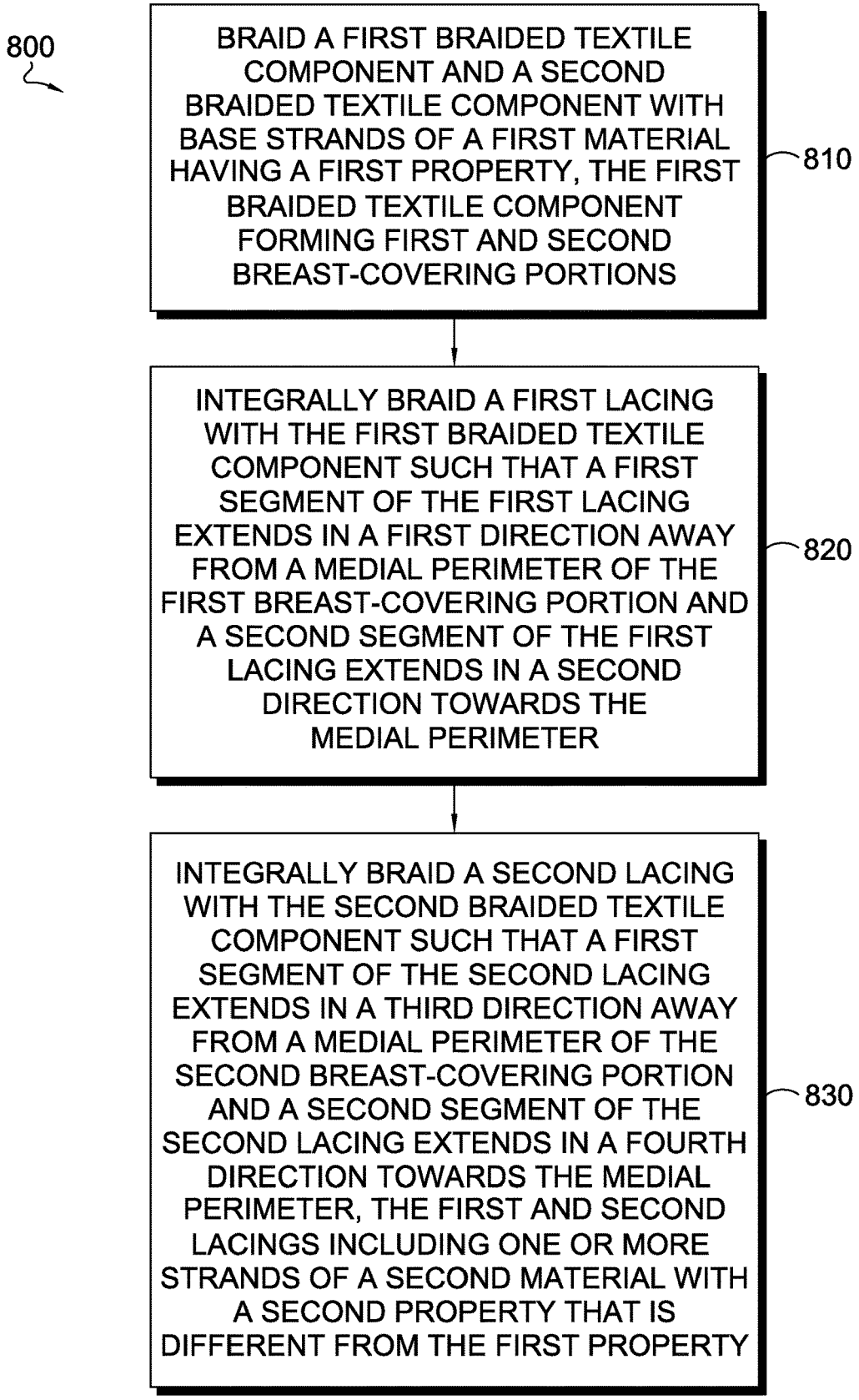
FIG. 8 illustrates a flow diagram of an example method of manufacturing a braided bra with integrated lacings in accordance with aspects herein.

Turning to FIG. 8, a flow diagram is provided depicting an example method 800 of manufacturing a bra, such as the bra 100 or the bra 700, with one or more integrated lacings. At step 810, a first braided textile component and a second braided textile component are braided with base strands and form first and second breast-covering portions, such as the first and second breast-covering portions 140 and 150 or the first and second breast-covering portions 740 and 750. The first braided textile component and the second braided textile component may collectively be described herein as braided textile component 130 or braided textile component 730. The base strands include a first material having a first property.

At step 820, a first lacing is integrally braided with the first braided textile component such that a first segment of the first lacing extends in a first direction away from a medial perimeter of the first breast-covering portion and a second segment of the first lacing extends in a second direction towards the medial perimeter. At step 830, a second lacing is integrally braided with the second braided textile component such that a first segment of the second lacing extends in a third direction away from a medial perimeter of the second breast-covering portion and a second segment of the second lacing extends in a fourth direction towards the medial perimeter. The first and second lacings include one or more strands of a second material with a second property that is different from the first property. For instance, the second material may have a greater denier and/or tenacity than the first material.

The first lacing may have features described with respect to the first lateral lacing 160 or 760, and the second lacing may have features described with respect to the second lateral lacing 170 or 770. As such, the first lacing may extend from a lower perimeter of the first breast-covering portion, along a lateral region of the first breast-covering portion, and to an upper region of the first breast-covering portion. Similarly, the second lacing may extend from a lower perimeter of the second breast-covering portion, along a lateral region of the second breast-covering portion, and to an upper region of the second breast-covering portion. In some aspects, the first direction and the second direction form an angle from about 45 degrees to about 135 degrees, and the third direction and the fourth direction also form an angle from about 45 degrees to about 135 degrees.

In some aspects, each lacing includes a portion that is integrally braided with the braided textile component and a portion that is unintegrated such that it may be grasped by a wearer's fingers and used as a pull to adjust the support of the bra. For example, the method 800 may include braiding the first segment and the second segment of the first lacing with the first breast-covering portion and floating an unintegrated segment of the first lacing over at least part of the first braided textile component in an upper region of the first breast-covering portion. Method 800 may similarly include integrally braiding the first segment and the second segment of the second lacing with the second breast-covering portion and floating an unintegrated segment of the second lacing over at least part of the second braided textile component in an upper region of the second breast-covering portion. In some aspects, each lacing includes a third integrated segment that may be slideable between two yarns or filaments of intersecting base strands as described with respect to FIG. 5 or may be interwoven with yarn or filaments of intersecting base strands as described with respect to FIG. 4.

Some aspects of 800 further include integrally braided medial lacings within the first and second braided textile components. The medial lacings may have features of the first and second medial lacings 780 and 790 described with respect to FIGS. 7A and 7B. As such, a first medial lacing may be integrally braided with the first braided textile component such that the first medial lacing extends from the lower perimeter of the first breast-covering portion, along a medial region of the first breast-covering portion, and to the upper region of the first breast-covering portion. A second medial lacing may be integrally braided with the second braided textile component such that the second medial lacing extends from the lower perimeter of the second breast-covering portion, along a medial region of the second breast-covering portion, and to the upper region of the second breast-covering portion. Each medial lacing may include one or more strands (e.g., two strands) of the second material having the second property.

Some aspects of method 800 include forming the first and second braided textile components on a circular braiding machine. The first braided textile component and the second braided textile component may be braided separately in two tubular braided structures. The first and second braided textile components may be removed from their respective tubular braided structures and affixed together. The first and second braided textile components may be affixed along their respective medial regions to form a center region (e.g., center regions 132 or 732) of the bra. The two braided textile components may be affixed by stitching, bonding, and the like. Alternatively, the two braided textile components may be braided as a unitary braided structure such that there is a seamless transition between the first and second breast-covering portions.

The first and second braided textile components may form a front portion of a bra, and further aspects of method 800 may include forming a back portion of the bra, such as the back portion 104 or the back portion 704. The back portion may be formed by braiding, knitting, or weaving, or a combination thereof. Additionally, in some aspects, the method 800 includes forming a front lining layer and affixing (via stitching, bonding, and the like) the front lining layer to an inner-facing surface of the first and second breast-covering portions. In example aspects, the front lining layer is formed by knitting, but it is contemplated that other processes, such as weaving, may be utilized.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: A bra comprising: a braided textile component forming a first breast-covering portion and a second breast-covering portion, the first breast-covering portion and the second breast-covering portion each braided together with base strands of a first material having a first property; and a first lateral lacing and a second lateral lacing each integrated into the braided textile component and each including one or more strands of a second material having a second property that is different from the first property of the first material, wherein the first lateral lacing extends from a lower perimeter of the first breast-covering portion, along a lateral region of the first breast-covering portion, and to an upper region of the first breast-covering portion, and wherein the second lateral lacing extends from a lower perimeter of the second breast-covering portion, along a lateral region of the second breast-covering portion, and to an upper region of the second breast-covering portion.

Clause 2: The bra according to clause 1, wherein the first lateral lacing is integrally braided with the base strands of the first breast-covering portion at least along the lateral region of the first breast-covering portion, and wherein the second lateral lacing is integrally braided with the base strands of the second breast-covering portion at least along the lateral region of the second breast-covering portion.

Clause 3: The bra according to any of clauses 1-2, wherein strands of the first lateral lacing are interwoven with one or more base strands of the first breast-covering portion, and wherein strands of the second lateral lacing are interwoven with one or more the base strands of the second breast-covering portion.

Clause 4: The bra according to any of clauses 1-3, wherein the first lateral lacing includes a first unintegrated section such that the first lateral lacing floats over at least part of the braided textile component in the upper region of the first breast-covering portion; and wherein the second lateral lacing includes a second unintegrated section such that the second lateral lacing floats over at least part of the braided textile component in the upper region of the second breast-covering portion.

Clause 5: The bra according to any of clauses 1-2, wherein: the first lateral lacing includes a first integrated segment that extends in a first direction away from a central region between the first breast-covering portion and the second breast-covering portion and a second integrated segment that extends in a second direction towards the central region, and the second lateral lacing includes a first integrated segment that extends in a third direction away from the central region and a second integrated segment that extends in a fourth direction towards the central region.

Clause 6: The bra according to any of clauses 1-5, wherein the first direction and the fourth direction are parallel, and wherein the second direction and the third direction are parallel.

Clause 7: The bra according to any of clauses 1-6, wherein the upper region of the first breast-covering portion forms a first shoulder portion and wherein the upper region of the second breast-covering region forms a second shoulder portion.

Clause 8: The bra according to any of clauses 1-7, wherein the first breast-covering portion and the second breast-covering portion are affixed together.

Clause 9: The bra according to any of clauses 1-8 further comprising a first medial lacing and a second medial lacing each integrated into the braided textile component and made of one or more strands of the second material, wherein: the first medial lacing extends from the lower perimeter of the first breast-covering portion, along a medial region of the first breast-covering portion, and towards the upper region of the first breast-covering portion; and the second medial lacing extends from the lower perimeter of the second breast-covering portion, along a medial region of the second breast-covering portion, and towards the upper region of the second breast-covering portion.

Clause 10: A braided textile component for a bra, the braided textile component comprising: base strands of a first material having a first property and forming a breast-covering portion; and a lacing including one or more strands of a second material integrally braided with a portion of the braided textile component such that a first segment of the lacing extends in a first direction away from a medial perimeter of the breast-covering portion and a second segment of the lacing extends in a second direction towards the medial perimeter, the second material having a second property that is different from the first property of the first material.

Clause 11: The braided textile component for the bra according to clause 10, wherein the lacing includes an unintegrated segment that floats over the braided textile component at a part of an upper region of the breast-covering portion.

Clause 12: The braided textile component for the bra according to any of clauses 10-11, The braided textile component for the bra of claim 10, wherein the second material has a higher denier than the first material.

Clause 13: The braided textile component for the bra according to any of clauses 10-12, wherein the lacing is a lateral lacing that extends from a lower perimeter of the breast-covering portion, along a lateral region of the breast-covering portion, and to an upper region of the breast-covering portion.

Clause 14: The braided textile component for the bra according to any of clauses 10-13 further comprising a medial lacing including one or more strands of the second material integrally braided with a second portion of the braided textile component along a medial region of the breast-covering portion, wherein a first segment of the medial lacing extends in a third direction towards the medial perimeter of the breast-covering portion and wherein a second segment of the lacing extends in a fourth direction away from the medial perimeter.

Clause 15: A method of manufacturing a bra, the method comprising: braiding a first braided textile component and a second braided textile component with base strands of a first material having a first property, the first braided textile component forming a first breast-covering portion and the second braided textile component forming a second breast-covering portion; integrally braiding a first lacing with the first braided textile component such that a first segment of the first lacing extends in a first direction away from a medial perimeter of the first breast-covering portion and a second segment of the first lacing extends in a second direction towards the medial perimeter; integrally braiding a second lacing with the second braided textile component such that a first segment of the second lacing extends in a third direction away from a medial perimeter of the second breast-covering portion and a second segment of the second lacing extends in a fourth direction towards the medial perimeter, the first lacing and the second lacing each including one or more strands of a second material that has a second property that is different from the first property of the first material.

Clause 16: The method of manufacturing according to clause 15, wherein the first braided textile component and the second braided textile component are braided separately and affixed together.

Clause 17: The method of manufacturing according to any of clauses 15-16, wherein the first lacing is a first lateral lacing that extends from a lower perimeter of the first breast-covering portion, along a lateral region of the first breast-covering portion, and to an upper region of the first breast-covering portion, and wherein the second lacing is a second lateral lacing that extends from a lower perimeter of the second breast-covering portion, along a lateral region of the second breast-covering portion, and to an upper region of the second breast-covering portion.

Clause 18: The method of manufacturing according to any of clauses 15-17 further comprising: integrally braiding a first medial lacing with the first braided textile component such that the first medial lacing extends from the lower perimeter of the first breast-covering portion, along a medial region of the first breast-covering portion, and to the upper region of the first breast-covering portion; and integrally braiding a second medial lacing with the second braided textile component such that the second medial lacing extends from the lower perimeter of the second breast-covering portion, along a medial region of the second breast-covering portion, and to the upper region of the second breast-covering portion, wherein each of the first medial lacing and the second medial lacing include one or more strands of the second material having the second property.

Clause 19: The method of manufacturing according to any of clauses 15-18, wherein the first direction and the second direction form an angle from about 45 degrees to about 135 degrees and wherein the third direction and the fourth direction form an angle from about 45 degrees to about 135 degrees.

Clause 20: The method of manufacturing according to any of clauses 15-19, wherein integrally braiding the first lacing with the first braided textile component comprises integrally braiding the first segment and the second segment of the first lacing with the first breast-covering portion and floating an unintegrated segment of the first lacing over at least part of the first braided textile component in an upper region of the first breast-covering portion; and wherein integrally braiding the second lacing into the second braided textile component comprises integrally braiding the first segment and the second segment of the second lacing with the second breast-covering portion and floating an unintegrated segment of the second lacing over at least part of the second braided textile component in an upper region of the second breast-covering portion.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A bra comprising: a braided textile component forming a first breast-covering portion and a second breast-covering portion, the first breast-covering portion and the second breast-covering portion each braided together with base strands of a first material having a first property; and a first lateral lacing at least partially interwoven with one or more of the base strands of the first breast-covering portion at least along a lateral region of the first breast-covering portion, and the second lateral lacing at least partially interwoven with one or more base strands of the second breast-covering portion along a lateral region of the second breast-covering portion, wherein the first lateral lacing and the second lateral lacing each including one or more strands of a second material having a second property that is different from the first property of the first material, wherein the first lateral lacing extends from a lower perimeter of the first breast-covering portion, along the lateral region of the first breast-covering portion, and to an upper region of the first breast-covering portion, and wherein the second lateral lacing extends from a lower perimeter of the second breast-covering portion, along the lateral region of the second breast-covering portion, and to an upper region of the second breast-covering portion.

2. The bra of claim 1, wherein the first lateral lacing includes a first unintegrated section such that the first lateral lacing floats over at least part of the braided textile component in the upper region of the first breast-covering portion; and wherein the second lateral lacing includes a second unintegrated section such that the second lateral lacing floats over at least part of the braided textile component in the upper region of the second breast-covering portion.

3. The bra of claim 1, wherein:

the first lateral lacing includes a first integrated segment that is interwoven with the base strands of the first breast-covering portion and extends in a first direction away from a central region between the first breast-covering portion and the second breast-covering portion and a second integrated segment that is interwoven with the base strands of the first breast-covering portion and extends in a second direction towards the central region, and the second lateral lacing includes a first integrated segment that is interwoven with the base strands of the second breast-covering portion and extends in a third direction away from the central region and a second integrated segment that is interwoven with the base strands of the second breast-covering portion and extends in a fourth direction towards the central region.

4. The bra of claim 3, wherein the first direction and the fourth direction are parallel, and wherein the second direction and the third direction are parallel.

5. The bra of claim 1, wherein the upper region of the first breast-covering portion forms a first shoulder portion and wherein the upper region of the second breast-covering region forms a second shoulder portion.

6. The bra of claim 1, wherein the first breast-covering portion and the second breast-covering portion are affixed together.

7. The bra of claim 1 further comprising a first medial lacing and a second medial lacing each integrated into the braided textile component and made of one or more strands of the second material, wherein:

the first medial lacing extends from the lower perimeter of the first breast-covering portion, along a medial region of the first breast-covering portion, and towards the upper region of the first breast-covering portion; and the second medial lacing extends from the lower perimeter of the second breast-covering portion, along a medial region of the second breast-covering portion, and towards the upper region of the second breast-covering portion.

8. A braided textile component for a bra, the braided textile component comprising: a breast-covering portion comprising base strands of a first material having a first property and braided together to form the breast-covering portion; and a lacing including one or more strands of a second material integrally braided with the base strands in a portion of the breast-covering portion such that a first segment of the lacing extends in a first direction away from a medial perimeter of the breast-covering portion and a second segment of the lacing extends in a second direction towards the medial perimeter, the second material having a second property that is different from the first property of the first material, the lacing including an unintegrated segment that floats over the braided textile component at a portion of an upper region of the breast-covering portion.

9. The braided textile component for the bra of claim 8, wherein the second material has a higher denier than the first material.

10. The braided textile component for the bra of claim 8, wherein the lacing is a lateral lacing that extends from a lower perimeter of the breast-covering portion, along a lateral region of the breast-covering portion, and to the upper region of the breast-covering portion.

11. The braided textile component for the bra of claim 10 further comprising a medial lacing including one or more strands of the second material integrally braided with a second portion of the breast-covering portion along a medial region of the breast-covering portion, wherein a first segment of the medial lacing extends in a third direction towards the medial perimeter of the breast-covering portion and wherein a second segment of the lacing extends in a fourth direction away from the medial perimeter.

12. A method of manufacturing a bra, the method comprising:

braiding together base strands of a first material having a first property to form a first braided textile component and a second braided textile component, the first braided textile component forming a first breast-covering portion and the second braided textile component forming a second breast-covering portion;

integrally braiding a first lacing with the first braided textile component such that a first segment of the first lacing extends in a first direction away from a medial perimeter of the first breast-covering portion and a second segment of the first lacing extends in a second direction towards the medial perimeter, the first lacing including an unintegrated segment that floats over the first braided textile component at a portion of an upper region of the first breast-covering portion; and integrally braiding a second lacing with the second braided textile component such that a first segment of the second lacing extends in a third direction away from a medial perimeter of the second breast-covering portion and a second segment of the second lacing extends in a fourth direction towards the medial perimeter, the second lacing including an unintegrated segment that floats over the second braided textile component at a portion of an upper region of the second breast-covering portion, the first lacing and the second lacing each including one or more strands of a second material that has a second property that is different from the first property of the first material.

13. The method of manufacturing a bra of claim 12, wherein the first braided textile component and the second braided textile component are braided separately and affixed together.

14. The method of manufacturing a bra of claim 12, wherein the first lacing is a first lateral lacing that extends from a lower perimeter of the first breast-covering portion, along a lateral region of the first breast-covering portion, and to the upper region of the first breast-covering portion, and wherein the second lacing is a second lateral lacing that extends from a lower perimeter of the second breast-covering portion, along a lateral region of the second breast-covering portion, and to the upper region of the second breast-covering portion.

15. The method of manufacturing a bra of claim 14 further comprising:

integrally braiding a first medial lacing with the first braided textile component such that the first medial lacing extends from the lower perimeter of the first breast-covering portion, along a medial region of the first breast-covering portion, and to the upper region of the first breast-covering portion; and integrally braiding a second medial lacing with the second braided textile component such that the second medial lacing extends from the lower perimeter of the second breast-covering portion, along a medial region of the second breast-covering portion, and to the upper region of the second breast-covering portion, wherein each of the first medial lacing and the second medial lacing includes one or more strands of the second material having the second property.

16. The method of manufacturing a bra of claim 12, wherein the first direction and the second direction form an angle from about 45 degrees to about 135 degrees and wherein the third direction and the fourth direction form an angle from about 45 degrees to about 135 degrees.

* * * * *